US010184771B2

(12) United States Patent
Bailey

(10) Patent No.: US 10,184,771 B2
(45) Date of Patent: Jan. 22, 2019

(54) METHOD OF INHIBITING A BLAST FROM AN EXPLOSIVE

(71) Applicant: Environmental Defence Systems Limited, Huddersfield (GB)

(72) Inventor: Richard Bailey, Huddersfield (GB)

(73) Assignee: Environmental Defence Systems Limited, Huddersfield (GB)

( * ) Notice: Subject to any disclaimer, the term of this patent is extended or adjusted under 35 U.S.C. 154(b) by 0 days.

(21) Appl. No.: 15/746,613

(22) PCT Filed: Aug. 4, 2016

(86) PCT No.: PCT/GB2016/052391
§ 371 (c)(1),
(2) Date: Jan. 22, 2018

(87) PCT Pub. No.: WO2017/025721
PCT Pub. Date: Feb. 16, 2017

(65) Prior Publication Data

US 2018/0224261 A1 Aug. 9, 2018

(30) Foreign Application Priority Data

Aug. 11, 2015 (GB) ..... 1514203.7

(51) Int. Cl.
*F42D 5/045* (2006.01)

(52) U.S. Cl.
CPC ..... *F42D 5/045* (2013.01)

(58) Field of Classification Search
CPC ..... F42D 5/045; F42D 5/05; F41H 5/0471; F41H 5/0478
See application file for complete search history.

(56) References Cited

U.S. PATENT DOCUMENTS 5,225,622 A 7/1993 Gettle et al.
5,864,767 A * 1/1999 Drumgoole ..... F42D 5/045 102/301

(Continued)

FOREIGN PATENT DOCUMENTS

EP 0725260 A1 8/1996
EP 1947247 A2 7/2008

(Continued)

OTHER PUBLICATIONS

United Kingdom Search Report for Application GB 1514203.7 dated Sep. 23, 2015, 1 page.

(Continued)

*Primary Examiner* — Stephen Johnson
*Assistant Examiner* — Joshua T Semick
(74) *Attorney, Agent, or Firm* — Howard & Howard Attorneys PLLC

(57) ABSTRACT

A method of inhibiting a blast from an explosive (7) comprising the steps of (a) providing a blast inhibiting blanket (1), the blast inhibiting blanket (1) comprising first and second water porous outer layers (2, 3) and an absorbent core /4) sandwiched therebetween, said absorbent core (4) comprising an absorbent crystalline material and an absorbent fibrous material; (b) arranging the blast inhibiting blanket (1) to cover the explosive (7) but spaced apart therefrom; and, (c) wetting the blast inhibiting blanket (1) either before or after arranging the blanket (1) to cover the explosive (7).

21 Claims, 5 Drawing Sheets

(56) References Cited

U.S. PATENT DOCUMENTS

Figure 1:
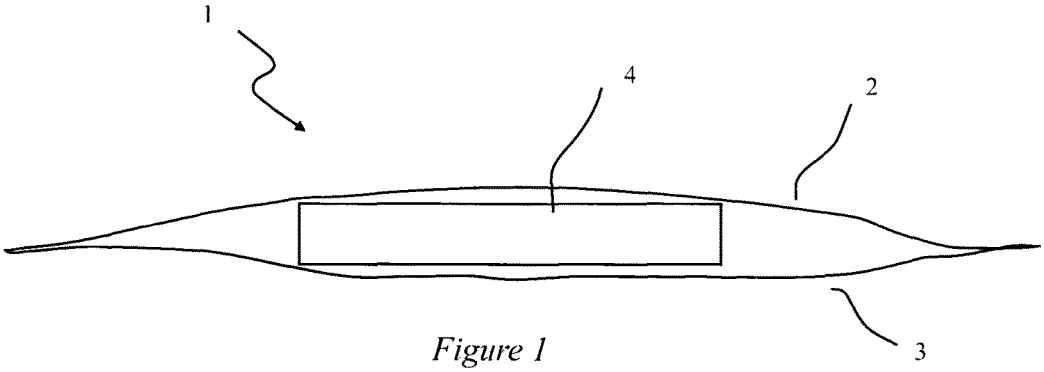

| | | | | |
|---|---|---|---|---|
| 6,371,977 | B1 * | 4/2002 | Bumbarger | A41D 31/0027 2/102 |
| 9,175,931 | B2 * | 11/2015 | Leivesley | A62D 5/00 |
| 2011/0174144 | A1 | 7/2011 | Kuchinsky et al. | |
| 2012/0257928 | A1 * | 10/2012 | Bailey | B01F 3/18 405/114 |

FOREIGN PATENT DOCUMENTS

| | | | |
|---|---|---|---|
| EP | 1947247 | A3 | 9/2008 |
| WO | 2008087439 | A2 | 7/2008 |
| WO | 2011061539 | A1 | 5/2011 |
| WO | 2015155514 | A1 | 10/2015 |

OTHER PUBLICATIONS

International Search Report for Application No. PCT/GB2016/052391 dated Oct. 13, 2016, 3 pages.

English language abstract and computer-generated English language translation for EP 0 725 260 A1 extracted from espacenet.com database on Feb. 1, 2018, 18 pages.

* cited by examiner

METHOD OF INHIBITING A BLAST FROM AN EXPLOSIVE

The subject application is the National Stage of International Patent Application No. PCT/GB2016/052391, filed on Aug. 4, 2016, which claims priority to and all the benefits of United Kingdom Patent Application No. 1514203.7, filed on Aug. 11, 2015, the contents of which are incorporated herein by reference in their entirety.

The present invention relates to a method of inhibiting a blast from an explosive. More particularly, but not exclusively, the present invention relates to a method of inhibiting a blast from an explosive comprising the steps of providing a blast inhibiting blanket, the blanket comprising a core at least a portion of which is a superabsorbent polymer, arranging the blanket to cover the explosive but spaced apart therefrom and wetting the blanket either before or after arranging the blanket to cover the explosive.

With the increase in terrorism worldwide the need to inhibit the effect of small (typically backpack or suitcase sized) explosives is on the increase. An explosion typically comprises two parts which need to be addressed. Firstly at the start of the explosion there is a flame. This flame very rapidly causes the explosive material to react and so explode. Secondly there is the shock wave caused by the explosion. This may cause structural damage. More significantly, the shock wave may propel undesirable material into the surrounding atmosphere. This can be a particular problem with 'dirty' nuclear or chemical bombs where the explosive is designed to propel undesirable radioactive material into the surrounding atmosphere, rather than cause structural damage.

A common method of reducing the effects of such an explosive is to pile sandbags or the like onto the explosive. This method is unsatisfactory for a number of reasons. Firstly such an approach makes no effort to extinguish the flame. Secondly, the effect of the shock wave is mitigated simply by the weight of the sandbags on the explosive. The pressure under the sandbags can rise to a considerable level and so a large number of sandbags are required. Typically there are not a large number of sandbags to hand and these need to be brought from a remote location. This can be time consuming. It can also be time consuming to arrange the sandbags into a pile of sufficient size.

In order to ameliorate these problems it is known to employ bags filled with a superabsorbent polymer. These are placed over the explosive and then wetted to increase their weight. Again, a significant number of such bags are required which may not be conveniently to hand.

Accordingly, the present invention provides a method of inhibiting a blast from an explosive comprising the steps of (a) providing a blast inhibiting blanket, the blast inhibiting blanket comprising first and second water porous outer layers and an absorbent core sandwiched therebetween, said absorbent core comprising an absorbent crystalline material and an absorbent fibrous material;
(b) arranging the blast inhibiting blanket to cover the explosive but spaced apart therefrom; and,
(c) wetting the blast inhibiting blanket either before or after arranging the blanket to cover the explosive.

The method according to the invention can be performed rapidly and used only lightweight and compact components which are often readily to hand. Further, and most importantly, the method inhibits explosions to a far greater degree than known methods which employ far heavier components.

Preferably the blanket is arranged before wetting.

Alternatively the blanket is arranged after wetting.

Preferably the absorbent crystalline material is a polymeric material.

Preferably the polymeric material is a superabsorbent polymer.

Preferably the superabsorbent polymer is one or more polyacrylate or polyacrylamide, preferably a polyacrylate and/or polyacrylamide salt.

Preferably the absorbent fibrous material is a cellulosic material.

Preferably the absorbent fibrous material comprises from 40% to 80% by weight of the total absorbent core.

Preferably the absorbent core comprises an admixture of absorbent crystalline material and absorbent fibrous material.

Alternatively the absorbent core comprises alternating layers of absorbent crystalline material and an absorbent fibrous material.

Preferably the blast inhibiting blanket further comprises at least one liner layer sandwiched between an outer layer and the core.

Preferably at least one of the outer layers comprises a plurality of apertures extending therethrough.

Preferably the blast inhibiting blanket is divided into separate portions by stitching lines.

Preferably the blast inhibiting blanket is arranged as a dome over the explosive.

Alternatively the blast inhibiting blanket is arranged as a box over the explosive.

Preferably the method further comprises the step of arranging a frame to cover the explosive but spaced apart therefrom and then arranging the blast inhibiting blanket on the frame.

Preferably the blast inhibiting blanket is arranged such that the distance between the centre of mass of the explosive and the nearest point of the blast inhibiting blanket is at least twice the width of the explosive, more preferably at least five times, more preferably at least ten times.

Preferably the method comprises the step of arranging a plurality of blast inhibiting blankets to each cover the explosive, each blast inhibiting blanket being spaced apart from the explosive and from each other blast inhibiting blanket.

Preferably the blast inhibiting blankets are equally separated from each other.

Figure 2:
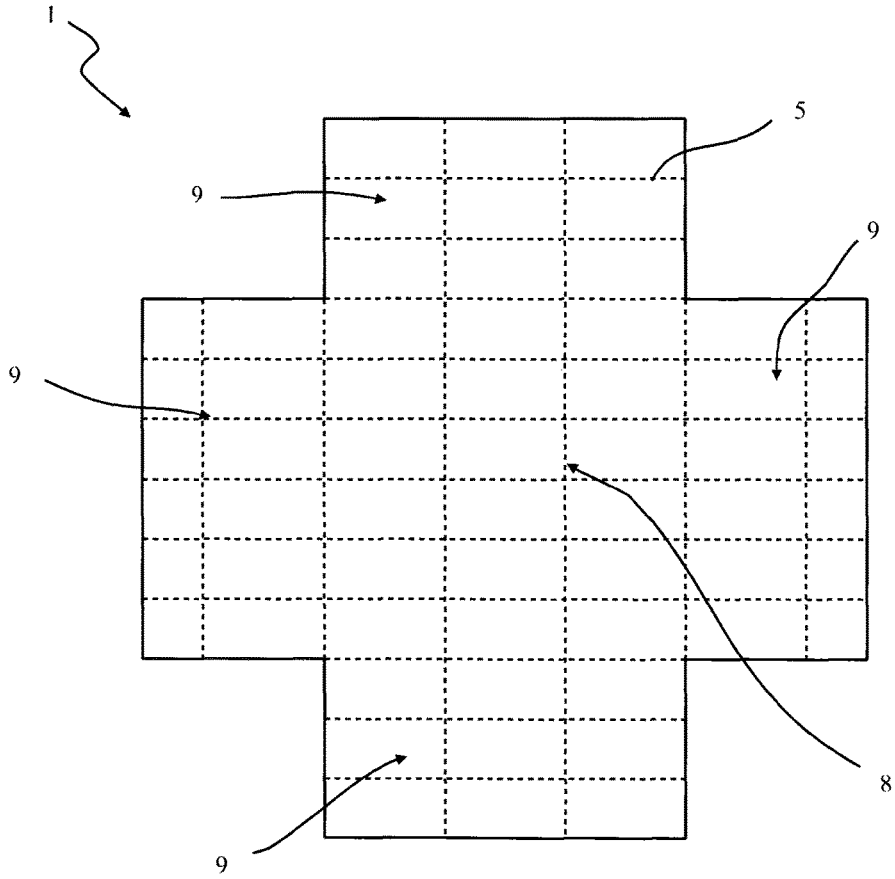
Figure 3A:
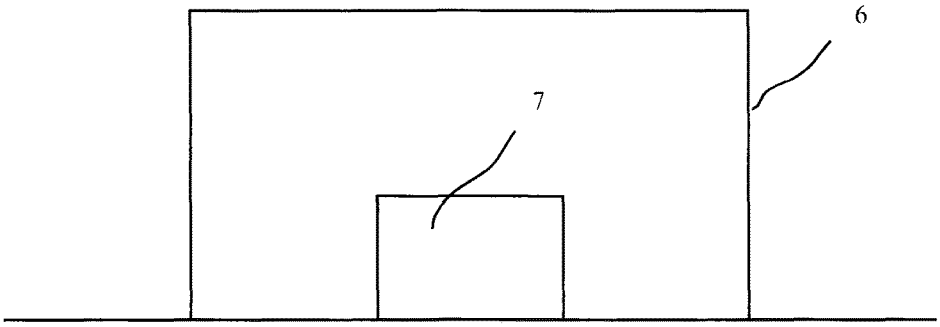
Figure 3B:
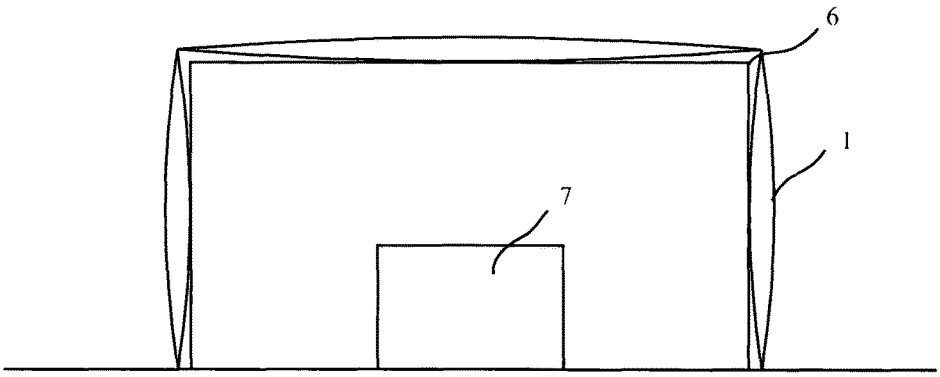
Figure 3C:
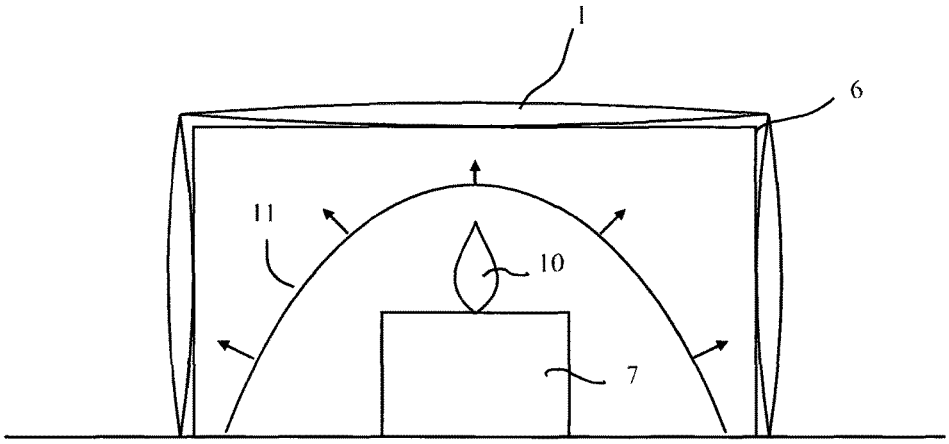
Figure 3D:
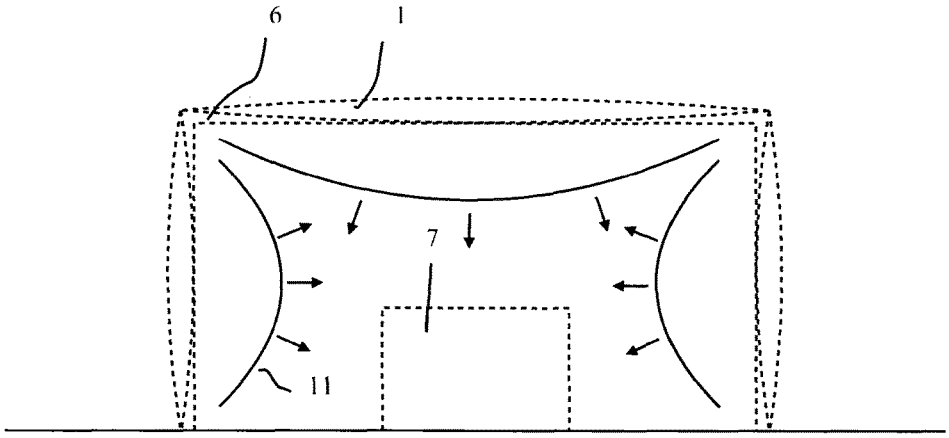
Figure 4:
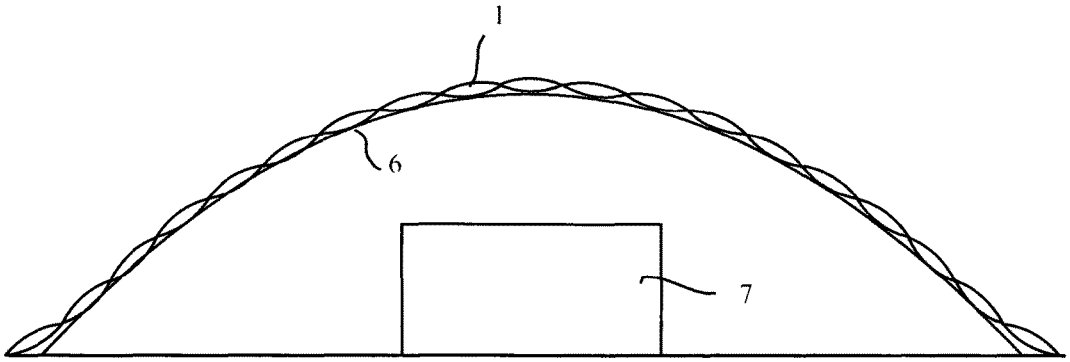
Figure 5:
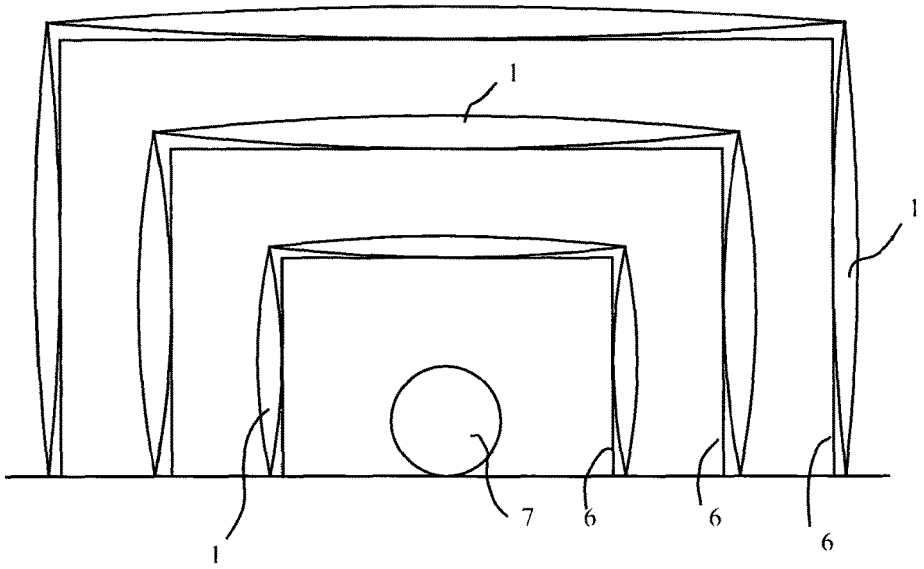

The present invention will now be described by way of example only and not in any limitative sense with reference to the accompanying drawings in which FIG. 1 shows a blast inhibiting blanket employed in a method according to the invention in cross section;

FIG. 2 shows the blast inhibiting blanket of FIG. 1 in plan view;

FIGS. 3(*a*) to 3(*d*) show the method according to the invention in schematic form;

FIG. 4 shows a frame and blast inhibiting blanket of an alternative embodiment of the invention; and, FIG. 5 shows an alternative embodiment of the method of the invention.

Shown in cross section in FIG. 1 is a blast inhibiting blanket 1 suitable for use in the method according to the invention. The blast inhibiting blanket 1 comprises first and second outer layers 2, 3 and an absorbent core 4 sandwiched therebetween. The two outer layers 2,3 are stitched together around the edges of the outer layers 2,3 as shown so keeping the core 4 between the outer layers.

Each of the outer layers 2, 3 is water porous. Each outer layer 2,3 is typically a natural material such as jute or hessian. Other materials can be used.

The absorbent core 4 comprises a mixture of an absorbent crystalline material and an absorbent fibrous material. The absorbent core 4 is shown in the dry state ie without water added. In use the absorbent crystalline material can absorb water and swell.

The absorbent fibrous material is typically a cellulosic material such as paper, wood pulp, cotton or the like. Absorbent crystals suitable for use in the absorbent core typically include a polymeric material such as a superabsorbent polymer, including the product Super Absorbent Polymer™. Such crystals may by way of example include sodium polyacrylate or polyacrylamide with a potassium salt base. Such substances can hold up to 200 times their weight in water.

In the embodiment of FIG. 1 the absorbent crystalline material and absorbent fibrous material are mixed together as an admixture. The absorbent crystalline material is preferably evenly distributed throughout the absorbent fibrous material to ensure the rapid and even uptake of water. In an alternative embodiment the absorbent crystalline material and the absorbent fibrous material are arranged in alternating layers.

Typically the absorbent fibrous material comprises from 40% to 80% by weight of the total absorbent core, more typically 50% to 75%, more typically 60% to 70%.

Arranged between the absorbent core 4 and the outer layers 2,3 are optional liner layers (not shown). The liner layers are typically a hydrophilic material to aid in the rapid uptake of water.

Shown in FIG. 2 is the blast inhibiting blanket 1 of FIG. 1 in plan view. The blanket 1 is divided by stitching lines into separate portions. The stitching lines 5 prevent the absorbent core 4 from moving and keeps it evenly distributed within the blanket 1.

FIGS. 3(*a*) to 3(*d*) show the method according to the invention. In a first step shown in FIG. 3(*a*) a frame 6 is arranged to cover an explosive 7. As can be seen the frame 6 is spaced apart from the explosive 7.

In a second step the blast inhibiting blanket 1 is wetted typically using water although other inert liquids are possible. The amount of water added may vary between instances of the method. Typically the amount of water added to the blanket 1 is at least equal to the weight of the blanket 1. Preferably the weight of water added is at least twice the weight of the blast inhibiting blanket 1, more preferably at least five times, more preferably at least twenty times. If the blanket 1 contains sufficient superabsorbent polymer the weight of water that can be added can be several hundred times the weight of the blanket 1.

Preferably the water is added evenly across the blanket 1 to minimise the occurrence of dry spots.

Once wetted the blanket 1 is placed over the frame 6 as shown in FIG. 3(*b*). The blanket 1 is spaced apart from the explosive 7 but covers the explosive 7 so that the shock wave and blast products produced by the explosive 7 are caught by the blanket 1. In this embodiment the frame 6 is shaped as a cube. As can been seen from FIG. 1(*b*) the blast inhibiting blanket 1 comprises a central section 8 and four side sections 9. The central section 8 is placed on the top face of the frame 6. The four side sections 9 fall down the sides of the frame 6 to form a cube. The side sections 9 are typically tied together or attached using Velcro straps or the like to maintain the blast inhibiting blanket 1 in a cube shape. Once the blast inhibiting blanket 1 is in position it can be further wetted if desired.

In an alternative embodiment, of a method according to the invention the blast inhibiting blanket 1 is arranged on the frame 6 in the dry state. It is then wetted. The blast inhibiting blanket 1 can be wetted from a distance for example with a hose pipe or sprinkler until the desired amount of water has been absorbed by the blanket 1.

Shown in FIG. 3(*c*) is the explosive 7 at the start of the blast. The explosive 7 produces a flame 10 and a blast wave 11 which expands out to the blast inhibiting blanket 1. When the blast wave 11 reaches the blast inhibiting blanket 1 the blast wave 11 compresses the blast inhibiting blanket 1. This converts the water retained within the blanket 1 into a high pressure water vapour mist within the frame 6. This rapidly extinguishes the flame 7 so preventing the explosion from developing. Further, the blast wave 11 is reflected off the sides of the blast inhibiting blanket 1 back towards the explosive 7. This reflection may destroy the blast inhibiting blanket 1. When the blast wave 11 meets itself it partially cancels itself out, so reducing the effect of the blast wave 11 and also reducing its ability to disperse undesirable explosion products into the surrounding atmosphere. This is shown in FIG. 3(*d*).

Shown in FIG. 4 is frame 6 and blast inhibiting blanket 1 employed in a variant of the method according to the invention. In this embodiment the frame 6 is domes shaped. The blast inhibiting blanket 1 is shaped to fit over the dome shaped frame 6 to cover the explosive 7.

Other shapes of frame 6 and blanket 1 are possible. In each case the frame 6 and blanket 1 are shaped to cover the explosive 7 to receive the blast wave and explosion products.

In an alternative embodiment of the invention the frame 6 is integral to the blast inhibiting blanket 1. Embodiments in which the frame 5 is separate from the blast inhibiting blanket 1 are preferred as in such embodiments the frame 6 can be collapsed and the blanket 1 folded so that they take up little volume are can be conveniently stored. In a further alternative embodiment the blast inhibiting blanket 1 is sufficiently rigid that a frame 6 is not required.

In an alternative embodiment of the invention the blast inhibiting blanket 1 comprises one or more apertures in at least one of the outer layers 2,3. Experiments have shown that these apertures aid in forming the high pressure mist which extinguishes the flame 7.

The size of the blast inhibiting blanket 1 is not critical. Preferably the distance between the center of mass of the explosive 7 and the nearest point of the blast inhibiting blanket 1 is at least twice the width of the explosive 7 in that direction, more preferably at least five times the width of the explosive 7, more preferably at least ten times the width of the explosive 7.

In an alternative embodiment of a method according to the invention more than one blast inhibiting blanket 1 is employed. This is shown schematically in FIG. 5. In this embodiment of the method each blast inhibiting blanket 1 is arranged on a frame 6 to cover the explosive 7, one inside the other. Preferably the blast inhibiting blankets 1 are equally spaced as shown.

As before, when the blast wave hits the first blast inhibiting blanket 1 a mist is formed which extinguishes the flame 7. The blast wave 11 is reflected back on itself from the first blast inhibiting blanket 1 so partially cancelling itself out. The partially cancelled blast wave 11 then travels to the second blast inhibiting blanket 1 where the process is repeated. Any desired reduction in the blast wave 11 can be achieved by employing the appropriate number of blast inhibiting blankets 1.

The invention claimed is:

1. A method of inhibiting a blast from an explosive comprising the steps of:

(a) providing a blast inhibiting blanket, the blast inhibiting blanket comprising first and second water porous outer layers and an absorbent core sandwiched therebetween, said absorbent core comprising an absorbent crystalline material and an absorbent fibrous material;

(b) arranging the blast inhibiting blanket to cover the explosive with the blast inhibiting blanket spaced apart from the explosive; and (c) wetting the blast inhibiting blanket either before or after the step of arranging the blanket to cover the explosive.

2. A method as claimed in claim 1, wherein the step of arranging the blast inhibiting blanket to cover the explosive occurs before the step of wetting the blast inhibiting blanket.

3. A method as claimed in claim 1, wherein the step of arranging the blast inhibiting blanket to cover the explosive occurs after the step of wetting the blast inhibiting blanket.

4. A method as claimed in claim 1, wherein the absorbent crystalline material is a polymeric material.

5. A method as claimed in claim 4, wherein the polymeric material is a superabsorbent polymer.

6. A method as claimed in claim 5, wherein the superabsorbent polymer is one or more of polyacrylate and polyacrylamide.

7. A method as claimed in claim 1, wherein the absorbent fibrous material is a cellulosic material.

8. A method as claimed in claim 7, wherein the absorbent fibrous material comprises from 40% to 80% by weight of the total absorbent core.

9. A method as claimed in claim 1, wherein the absorbent core comprises an admixture of the absorbent crystalline material and the absorbent fibrous material.

10. A method as claimed in claim 1, wherein the absorbent core comprises alternating layers of the absorbent crystalline material and the absorbent fibrous material.

11. A method as claimed in claim 1, wherein at least one of the first and second water porous outer layers comprises a plurality of apertures extending therethrough.

12. A method as claimed in claim 1, wherein the blast inhibiting blanket is divided into separate portions by stitching lines.

13. A method as claimed in claim 1, wherein the step of arranging the blast inhibiting blanket includes arranging the blast inhibiting blanket as a dome over the explosive.

14. A method as claimed in claim 1, wherein the step of arranging the blast inhibiting blanket includes arranging the blast inhibiting blanket as a box over the explosive.

15. A method as claimed in claim 1, further comprising the step of arranging a frame to cover the explosive with the frame spaced apart from the explosive, and then arranging the blast inhibiting blanket on the frame.

16. A method as claimed in claim 1, wherein the explosive has a centre of mass and a width and the step of arranging the blast inhibiting blanket includes arranging the blast inhibiting blanket such that a distance between the centre of mass of the explosive and a nearest point of the blast inhibiting blanket is at least twice the width of the explosive.

17. A method as claimed in claim 1, further comprising the step of arranging a plurality of blast inhibiting blankets to each cover the explosive with each one of the blast inhibiting blankets being spaced apart from the explosive and from each of the other blast inhibiting blankets.

18. A method as claimed in claim 17, wherein the blast inhibiting blankets are equally separated from each other.

19. A method as claimed in claim 5, wherein the superabsorbent polymer is a polyacrylate and/or polyacrylamide salt.

20. A method as claimed in claim 1, wherein the explosive has a centre of mass and a width and the step of arranging the blast inhibiting blanket includes arranging the blast inhibiting blanket such that a distance between the centre of mass of the explosive and a nearest point of the blast inhibiting blanket is at least five times the width of the explosive.

21. A method as claimed in claim 1, wherein the explosive has a centre of mass and a width and the step of arranging the blast inhibiting blanket includes arranging the blast inhibiting blanket such that a distance between the centre of mass of the explosive and a nearest point of the blast inhibiting blanket is at least ten times the width of the explosive.

* * * * *